US006788276B2

(12) United States Patent
Eo

(10) Patent No.: US 6,788,276 B2
(45) Date of Patent: Sep. 7, 2004

(54) APPARATUS FOR CONTROLLING DRIVE-POWER OF PLASMA DISPLAY PANEL AND A METHOD THEREFOR

(75) Inventor: Yoon-phil Eo, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 64 days.

(21) Appl. No.: 09/778,962

(22) Filed: Feb. 8, 2001

(65) Prior Publication Data

US 2001/0026253 A1 Oct. 4, 2001

(30) Foreign Application Priority Data

Feb. 8, 2000 (KR) ..... 2000-5731

(51) Int. Cl.[7] ..... G09G 3/28
(52) U.S. Cl. ..... 345/60; 345/204
(58) Field of Search ..... 345/60–72, 204, 345/211–213; 315/169.4

(56) References Cited

U.S. PATENT DOCUMENTS 6,310,588 B1 * 10/2001 Kawahara et al. ..... 345/63
6,326,938 B1 * 12/2001 Ishida et al. ..... 345/211

FOREIGN PATENT DOCUMENTS

| | | | | |
|---|---|---|---|---|
| JP | 08-065583 | * | 3/1996 | ..... H04N/5/44 |
| JP | 08-205049 | * | 8/1996 | ..... H04N/5/57 |
| JP | 2000-194318 | * | 7/2000 | ..... G09G/3/28 |

* cited by examiner

*Primary Examiner*—Alexander Eisen
(74) *Attorney, Agent, or Firm*—McGuireWoods LLP

(57) ABSTRACT

An apparatus for controlling the drive power of a plasma display panel in an driving apparatus of the plasma display panel. The apparatus preestimates a load ratio of an input video signal on a frame-by-frame basis, controls a number of display-discharge pulses in a corresponding frame to be inversely proportional to the preestimated load ratio, measures correlation of each frame with a preceding frame, controls the output timing of a discharge number controller according to the correlation and regulates a rate of change of the number of display-discharge pulses in a frame. The number of display discharge pulses in a frame is regulated to change more rapidly where the correlation is low and than where the correlation is high.

6 Claims, 4 Drawing Sheets

FIG. 6

11

| | | | | | | | | |
|---|---|---|---|---|---|---|---|---|
| $G_{11}$ | $G_{12}$ | $G_{13}$ | $G_{14}$ | $G_{15}$ | $G_{16}$ | $G_{17}$ | $G_{18}$ | $G_{19}$ |
| $G_{21}$ | $G_{22}$ | $G_{23}$ | $G_{24}$ | $G_{25}$ | $G_{26}$ | $G_{27}$ | $G_{28}$ | $G_{29}$ |
| $G_{31}$ | $G_{32}$ | $G_{33}$ | $G_{34}$ | $G_{35}$ | $G_{36}$ | $G_{37}$ | $G_{38}$ | $G_{39}$ |
| $G_{41}$ | $G_{42}$ | $G_{43}$ | $G_{44}$ | $G_{45}$ | $G_{46}$ | $G_{47}$ | $G_{48}$ | $G_{49}$ |
| $G_{51}$ | $G_{52}$ | $G_{53}$ | $G_{54}$ | $G_{55}$ | $G_{56}$ | $G_{57}$ | $G_{58}$ | $G_{59}$ |
| $G_{61}$ | $G_{62}$ | $G_{63}$ | $G_{64}$ | $G_{65}$ | $G_{66}$ | $G_{67}$ | $G_{68}$ | $G_{69}$ |
| $G_{71}$ | $G_{72}$ | $G_{73}$ | $G_{74}$ | $G_{75}$ | $G_{76}$ | $G_{77}$ | $G_{78}$ | $G_{79}$ |
| $G_{81}$ | $G_{82}$ | $G_{83}$ | $G_{84}$ | $G_{85}$ | $G_{86}$ | $G_{87}$ | $G_{88}$ | $G_{89}$ |
| $G_{91}$ | $G_{92}$ | $G_{93}$ | $G_{94}$ | $G_{95}$ | $G_{96}$ | $G_{97}$ | $G_{98}$ | $G_{99}$ |

FIG. 7B

11

PRECEDING FRAME

| | | | | | | | | |
|---|---|---|---|---|---|---|---|---|
| 0 | 0 | 100 | 10 | 20 | 30 | 40 | 0 | 0 |
| 0 | 0 | 10 | 20 | 50 | 60 | 70 | 0 | 0 |
| 0 | 0 | 80 | 90 | 100 | 110 | 120 | 0 | 0 |
| 0 | 0 | 130 | 140 | 150 | 160 | 170 | 0 | 0 |
| 0 | 180 | 190 | 200 | 1400 | 1300 | 1400 | 0 | 0 |
| 1700 | 1500 | 210 | 220 | 1500 | 1500 | 500 | 0 | 0 |
| 2000 | 1700 | 1700 | 230 | 240 | 250 | 260 | 0 | 0 |
| 270 | 280 | 290 | 300 | 400 | 500 | 600 | 0 | 0 |
| 700 | 800 | 900 | 1000 | 1500 | 1300 | 900 | 0 | 0 |

FIG. 7A

11

PRESENT FRAME

| | | | | | | | | |
|---|---|---|---|---|---|---|---|---|
| 0 | 0 | 100 | 900 | 890 | 870 | 400 | 0 | 0 |
| 0 | 0 | 10 | 20 | 750 | 760 | 700 | 0 | 0 |
| 0 | 0 | 300 | 320 | 350 | 330 | 310 | 0 | 0 |
| 0 | 0 | 430 | 470 | 460 | 450 | 400 | 0 | 0 |
| 0 | 180 | 250 | 290 | 1400 | 1300 | 1400 | 0 | 0 |
| 1700 | 1500 | 900 | 1000 | 1500 | 1500 | 500 | 0 | 0 |
| 2000 | 1700 | 1700 | 390 | 480 | 450 | 460 | 0 | 0 |
| 300 | 310 | 320 | 390 | 380 | 510 | 520 | 0 | 0 |
| 10 | 20 | 30 | 40 | 70 | 80 | 60 | 0 | 0 |

APPARATUS FOR CONTROLLING DRIVE-POWER OF PLASMA DISPLAY PANEL AND A METHOD THEREFOR

CROSS-REFERENCE TO RELATED APPLICATIONS

This application claims the benefit of Korean Application No. 00-5731 filed Feb. 8, 2000 in the Korean Patent Office, the disclosure of which is incorporated herein by reference.

BACKGROUND OF THE INVENTION

1. Field of the Invention

The present invention relates to an apparatus for controlling the drive power of a plasma display panel and a method therefor, and more particularly, to a method and apparatus which pre-estimates a load ratio, which is the ratio of the number of discharge cells to be display-discharged to the total number of discharge cells in the plasma display panel, on a frame-by-frame basis, and controls the number of display-discharge pulses in a corresponding frame so that the number of display-discharge pulses in the corresponding frame is inversely proportional to the preestimated load ratio.

2. Description of the Related Art

Since plasma display panels have high power consumption due to their drive characteristics, an apparatus for controlling power consumption depending on the load ratio of a frame to be displayed is greatly required.

Referring to FIG. 1, a driving apparatus of a typical plasma display panel 1 includes a controller 2, an address driver 3, an X driver 4, and a Y driver 5. The controller 2 generates drive control signals $S_A$, $S_Y$, and $S_X$ according to an incoming video signal. The address driver 3 processes an address signal $S_A$ from the controller 2 to generate a display data signal, and then applies the generated display data signal to address electrode lines. The X driver 4 processes an X drive control signal $S_X$ from the controller 2 to apply the processed X drive control signal $S_X$ to X electrode lines. The Y driver 5 processes a Y drive control signal $S_Y$ to apply the processed Y drive control signal $S_Y$ to Y electrode lines.

FIG. 2 shows the internal configuration of the controller 2 in the apparatus of FIG. 1. Referring to FIG. 2, the controller 2 includes a subfield generator 21, a power controller 22, a subfield matrix 23, a frame memory 24, a memory interface 25, a rearranger 26, a timing signal generator 27, XY switches 28, and a memory 29. The subfield generator 21 converts input video data signals red (R), green (G) and blue (B) to gray-scale data signals. The subfield matrix 23 classifies the gray-scale data signals based on the type of gray scales. The memory interface 25 stores the classified data signals from the subfield matrix 23 in the frame memory 24, and inputs frame data from the frame memory 24 into the rearranger 26. The rearranger 26 rearranges the frame data input through the memory interface 25 in such a way as to be well suited to a predetermined driving sequence, and outputs the address signal $S_A$ as the result thereof.

The timing signal generator 27 generates a timing signal according to an input horizontal synchronization signal $H_{SYNC}$, a vertical synchronization signal $V_{SYNC}$, a clock signal CLK, and a driving sequence permanently stored in the memory 29 such as a programmable read only memory (PROM). The XY switches 28 operate according to the predetermined driving sequence and switch the timing signal from the timing signal generator 27 to output the X drive control signal $S_X$ and the Y drive control signal $S_Y$.

Here, the power controller 22 processes the input video data signals R, G, and B to preestimate a load ratio, which is the ratio of the number of discharge cells to be display-discharged to the number of discharge cells of the plasma display panel 1, on a frame-by-frame basis, and to input a discharge number control signal APC to the timing signal generator 27. The timing signal generator 27 then controls the number of display-discharge pulses in a corresponding frame in such a way as to be inversely proportional to the preestimated load ratio. The operation principle of the power controller 22 is based on a drive characteristic graph shown in FIG. 3.

The drive characteristic graph of FIG. 3 is obtained as follows. First, a load ratio versus electric power characteristic is obtained while changing the number Ns of display-discharge pulses in a frame. Then, load ratios L4, L3, L2 and L1 are equated to reference electric power values with respect to each of the number Ns of display-discharge pulses in a frame. In this case, a load ratio of 100% is set for the lowest number Ns (=500) of display-discharge pulses in a frame. Based on this principle, the following power control is performed depending on the load ratio, L4, L3, L2 and L1.

The highest number Ns (=2,000) of display-discharge pulses in a frame is applied to the load ratio of 0 through L4. The next highest number Ns (=1,500) of display-discharge pulses in a frame is applied to the load ratio which is greater than L4 and less than or equal to L3. The next highest number Ns (=1,000) of display-discharge pulses in a frames is applied to the load ratio which is greater than L3 and less than or equal to L2. The lowest number (=500) Ns of display-discharge pulses in a frame is applied to the load ratio which is greater than L2. Here, the load ratio L1 denotes a load ratio of 100% where all discharge cells perform display-discharge.

The cross points P1, P2, P3, and P4 of the load ratio corresponding to the electric power are linked together to obtain a drive characteristic curve. The number Ns of display-discharge pulses in a frame and the load ratio can be appropriately selected within a range not deviating from the thus-obtained drive characteristic.

FIG. 4 shows the internal configuration of a conventional power controller. Referring to FIG. 4, the conventional power controller includes a load ratio preestimator 41, a low pass filter (LPF) 42, and a discharge number controller 43. The load ratio preestimator 41 preestimates a load ratio, which is the ratio of the number of discharge cells to be display-discharged to the total number of discharge cells in a plasma display panel, by a frame-by-frame basis. The LPF 42 works such that the level of an output signal from the load ratio preestimator 41 does not rapidly change. The discharge number controller 43 outputs a discharge number control signal APC corresponding to the load ratio signal from the LPF 42.

Here, if a level of an output signal from the load ratio preestimator 41 rapidly changes, for example, if the load ratio drops from 95% to 10%, the number Ns of display-discharge pulses in a frame rapidly changes accordingly by the discharge number controller 43. The LPF serves to prevent an electric shock of a system due to the rapid change. However, since the control of the discharge number controller 43 is always delayed by a predetermined time by the LPF 42, where a quickly moving object is displayed on a screen, power consumption increases at the point where this delay occurs. Thus, a speed of changing the display-discharge number per frame is always continuous. In other words, a transition time for changing the display-discharge number is always continuous according to the prior art. Thus, the control of the discharge number controller is inaccurate during the transition time. Where a quickly moving object is displayed, the average range for changing the display discharge number is relatively increased, so that the control of the discharge number controller is more inaccurate during the transition time. Thereby, according to the prior art, power consumption in a plasma display panel can increase more during the transition time.

SUMMARY OF THE INVENTION

To solve the above problems, it is an object of the present invention to provide an apparatus which controls the drive power of a plasma display panel that maintains constant power consumption without imposing electrical shock on a system.

It is also an object of the present invention to provide a method of controlling the drive power of a plasma display panel that maintains constant power consumption without imposing electrical shock on a system.

Additional objects and advantages of the invention will be set forth in part in the description which follows, and, in part, will be obvious from the description, or may be learned by practice of the invention.

Accordingly, to achieve the above and other objects, the present invention provides a method of controlling drive power of a plasma display panel by preestimating a load ratio, which is the ratio of the number of discharge cells to be display-discharged to the total number of discharge cells in the plasma display panel, on a frame-by-frame basis and controlling the number of display-discharge pulses in a corresponding frame so as to be inversely proportional to the preestimated load ratio, while driving the plasma display panel. The method comprises processing input video signals and measuring correlation of each frame with a preceding frame and regulating a speed at which the number of display-discharge pulses in a frame is controlled, depending on the correlation, i.e., regulating a rate of change of the number of display-discharge pulses per frame depending on the correlation.

The present invention provides an apparatus which controls the drive power of the plasma display panel in a driving apparatus of a plasma display panel. A load ratio preestimator preestimates a load ratio on a frame-by-frame basis, the load ratio being the ratio of the number of discharge cells to be display-discharged to the total number of discharge cells in the plasma display panel, a discharge number controller which controls a number of display-discharge pulses in a corresponding frame to be inversely proportional to the preestimated load ratio from the load ratio preestimator, a correlation number counter which processes input video signals and measures correlation of each frame with its preceding frame, and a control-timing regulator which controls the output timing of the discharge number controller according to the correlation from the correlation number counter and regulates a speed at which the number of display-discharge pulses in a frame is controlled. That is, the control-timing regulator regulates a rate of change of the number of display-discharge pulses per frame based on the correlation number.

BRIEF DESCRIPTION OF THE DRAWINGS

The above object and other objects and advantages of the present invention will become more apparent by describing in detail an embodiment thereof with reference to the attached drawings in which:

FIG. 6 shows a state in which a screen is divided in order to divide discharge cells of a plasma display panel into a plurality of groups;

FIG. 7A shows typical average signal levels of each of the groups shown in FIG. 6 for a present frame;

FIG. 7B shows typical average signal levels of each of the groups shown in FIG. 6 for a preceding frame.

DESCRIPTION OF THE PREFERRED EMBODIMENTS

Figure 1:
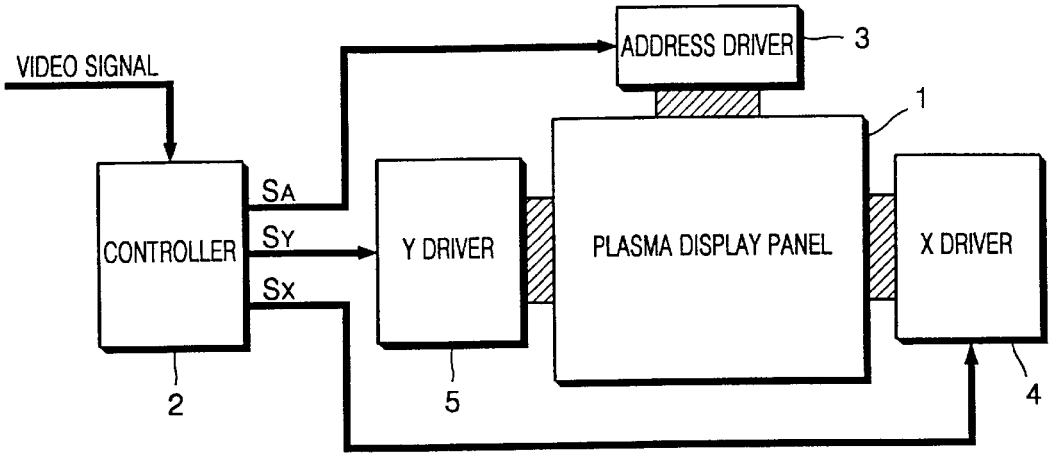
FIG. 1 (PRIOR ART)
FIG. 1 is a block diagram of an driving apparatus of a typical plasma display panel.
Figure 2:
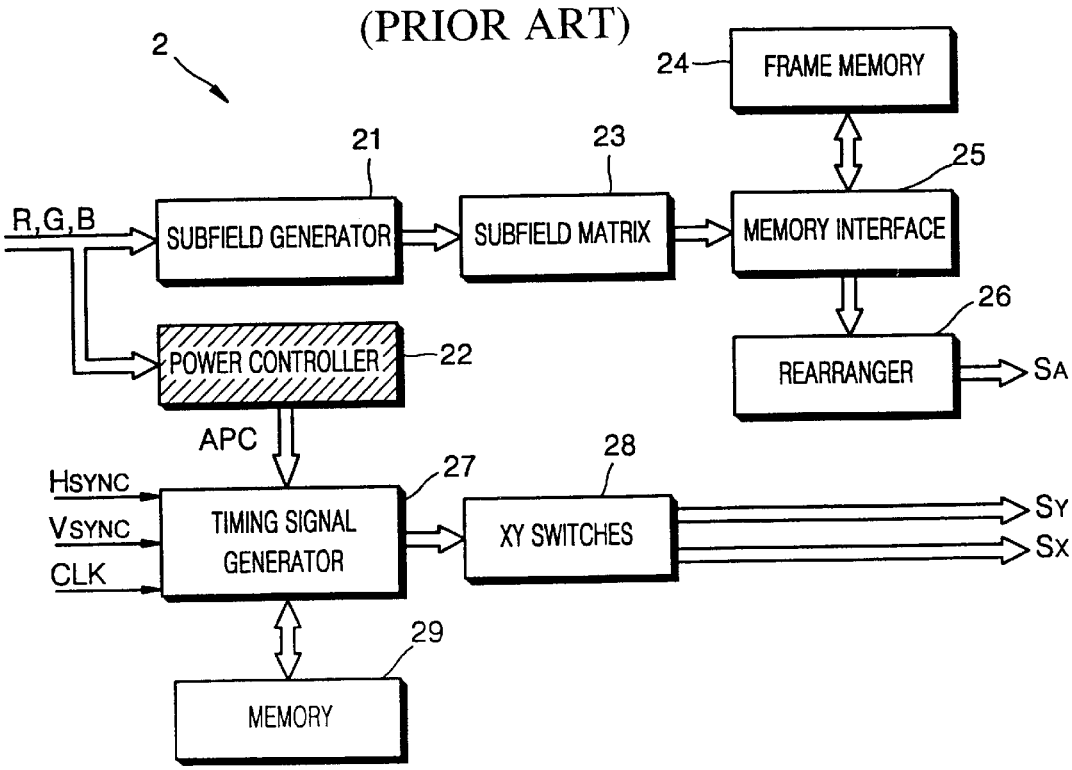
FIG. 2 (PRIOR ART)
FIG. 2 is a block diagram showing the internal configuration of the controller in the apparatus of FIG. 1.
Figure 3:
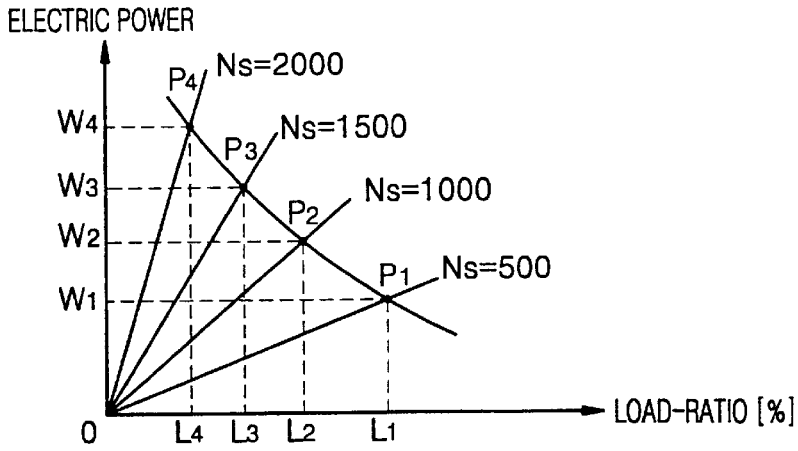
FIG. 3 (PRIOR ART)
FIG. 3 is a graph showing the operation principle of the power controller in the controller of FIG. 2.
Figure 4:
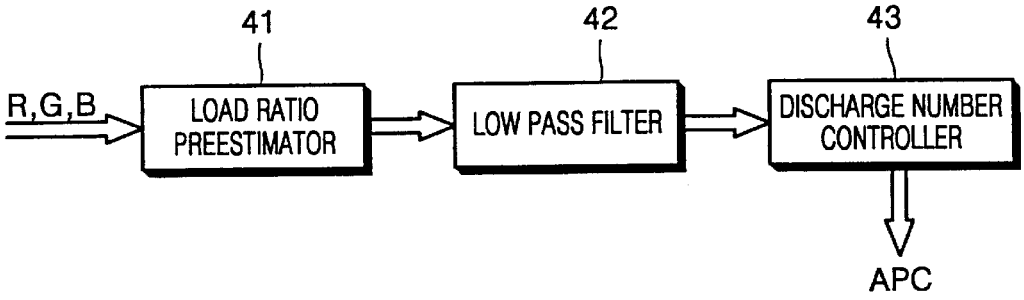
FIG. 4 (PRIOR ART)
FIG. 4 is a block diagram showing the internal configuration of a conventional power controller.

Reference will now be made in detail to the present embodiments of the present invention, examples of which are illustrated in the accompanying drawings, wherein like reference numerals refer to like elements throughout.

Figure 5:
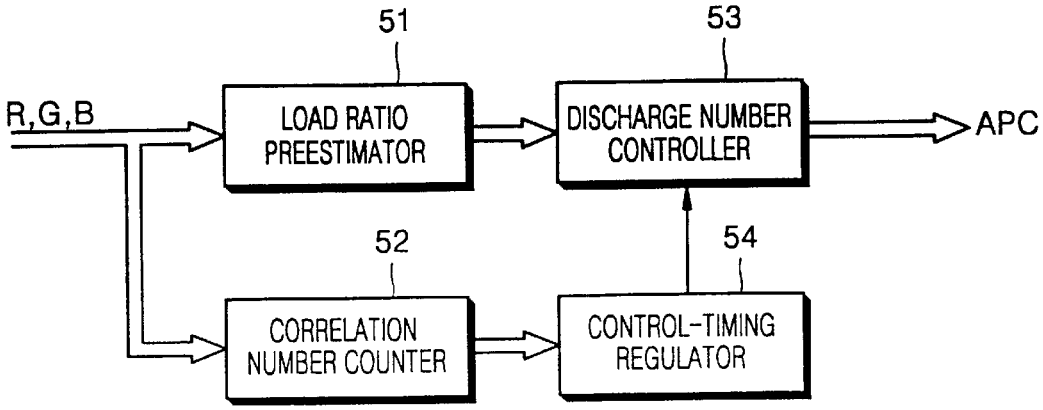
FIG. 5 is a block diagram showing the internal configuration of a power controller according to an embodiment of the present invention.
Figure 1:
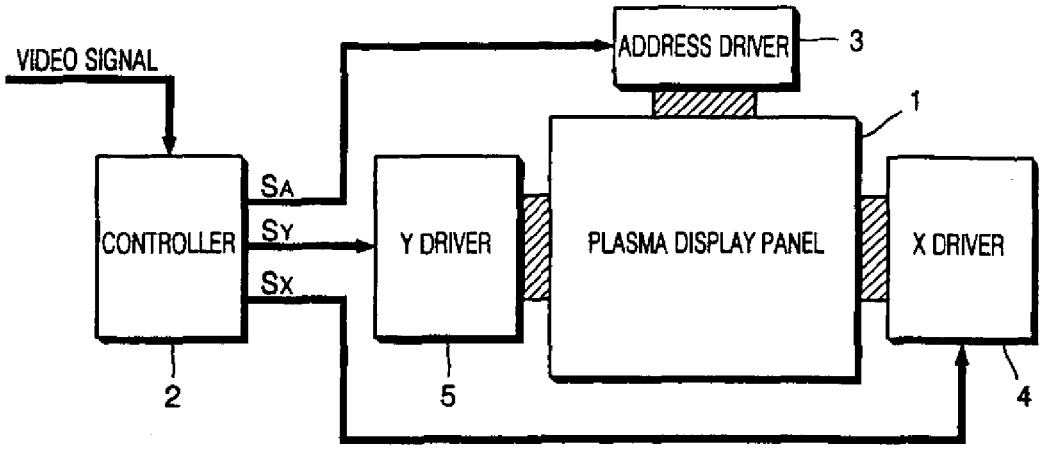
FIG. 1 (PRIOR ART)
Figure 2:
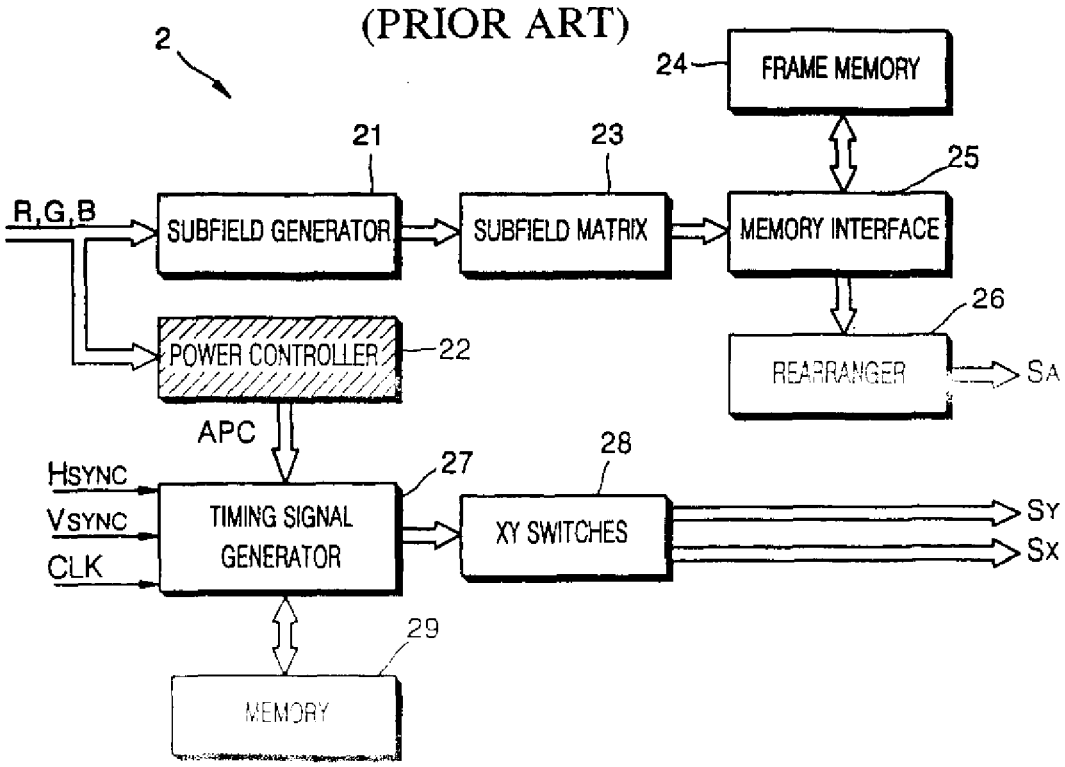
FIG. 2 (PRIOR ART)
Figure 3:
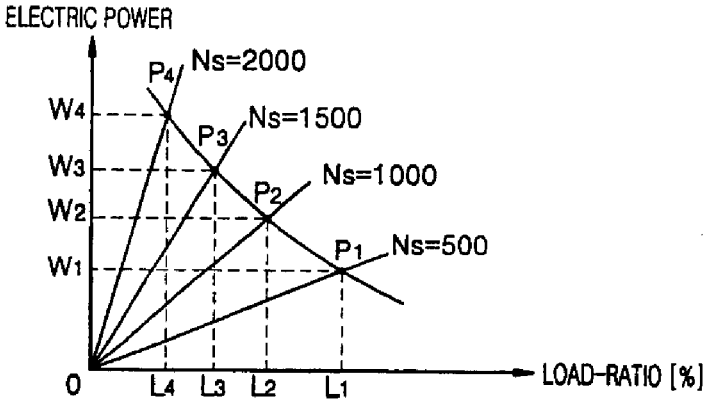
FIG. 3 (PRIOR ART)
Figure 4:
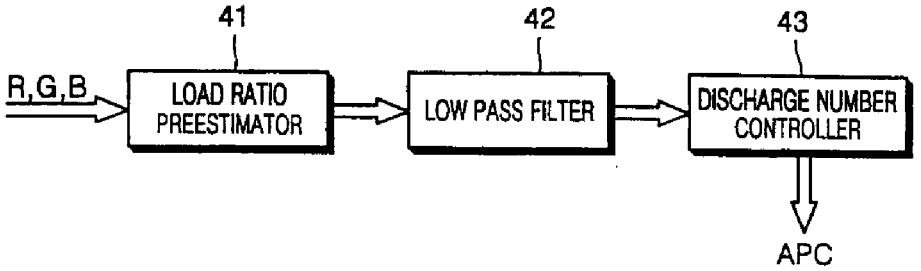
FIG. 4 (PRIOR ART)
Figure 5:
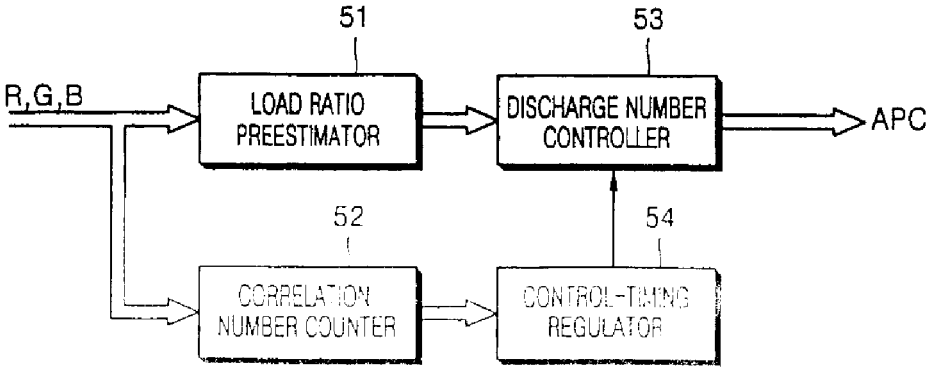

Referring to FIG. 5, a power controller according to the present invention, which controls the drive power of a plasma display panel included in a driving apparatus of the plasma display panel, is illustrated. The power controller includes a load ratio preestimator 51, a discharge number controller 53, a correlation number counter 52, and a control-timing regulator 54.

The load ratio preestimator 51 preestimates a load ratio, which is the ratio of the number of discharge cells to be display-discharged to the total number of discharge cells in the plasma display panel, on a frame-by-frame basis, by calculating the average signal level of input video data signals red (R), green (G), and blue (B). The discharge number controller 53 controls a number of display-discharge pulses in a corresponding frame to be inversely proportional to a preestimated load ratio from the load ratio preestimator 51. The correlation number counter 52 processes the input video data signals R, G, and B to measure the correlation of each frame with a preceding frame. The control-timing regulator 54 controls output timing of the discharge number controller 53 depending on the measured correlation from the correlation number counter 52 and regulates a speed at which the number of display-discharge pulses in a frame is controlled.

To establish an internal algorithm of the correlation number counter 52, discharge cells of the plasma display panel are divided into a plurality of groups, where each group is related to a predetermined area of a screen. In an example shown in FIG. 6, the discharge cells are divided into eighty-one groups over a screen 11 of the plasma display panel. The correlation number counter 52 processes the input video signals R, G, and B to calculate the average signal level of each of the eighty-one groups per frame. The calculated average signal level of each group in a present frame is compared with that of a corresponding group in a preceding frame to obtain correlation. Correlation means the number of groups in a present frame having the same average signal levels as corresponding groups in a preceding frame.

FIG. 7A shows an average signal level of each group shown in FIG. 6 for a present frame and FIG. 7B shows an average signal level of each group shown in FIG. 6 for a preceding frame. A comparison of the corresponding average signal levels in FIGS. 7A and 7B shows the number of groups having the same average signal levels in the preceding and present frames over the screen 11 of the plasma display panel is forty-two (See shadowed regions). The number of corresponding values is referred to as a correlation value. Where the correlation value, such as a value forty-two (42) in the examples shown in FIG. 7A and 7B is less than a reference value, such as for example, forty five (45), the control-timing regulator 54 controls the output timing of the discharge number controller 53 so that a rate of change of the number of display-discharge pulses in a frame starts quickly. That is, if a correlation value is lower than the reference value, it is considered that scenes of a motion picture shift quickly, the rate of change of the number of display-discharge pulses in a frame is initiated fast, thereby allowing power consumption to be constantly maintained. Conversely, if a correlation value is greater than the reference value, the control-timing regulator 54 controls the output timing of the discharge number controller 53 so that the rate of change of the number of display-discharge pulses in a frame starts slowly. That is, if the correlation value is higher than the reference value, it is considered that scenes of the motion picture change slowly. Thus, although the rate of change of the number of display-discharge pulses in a frame starts slowly, constant power consumption is maintained without imposing an electrical shock on a system.

Figure 8:
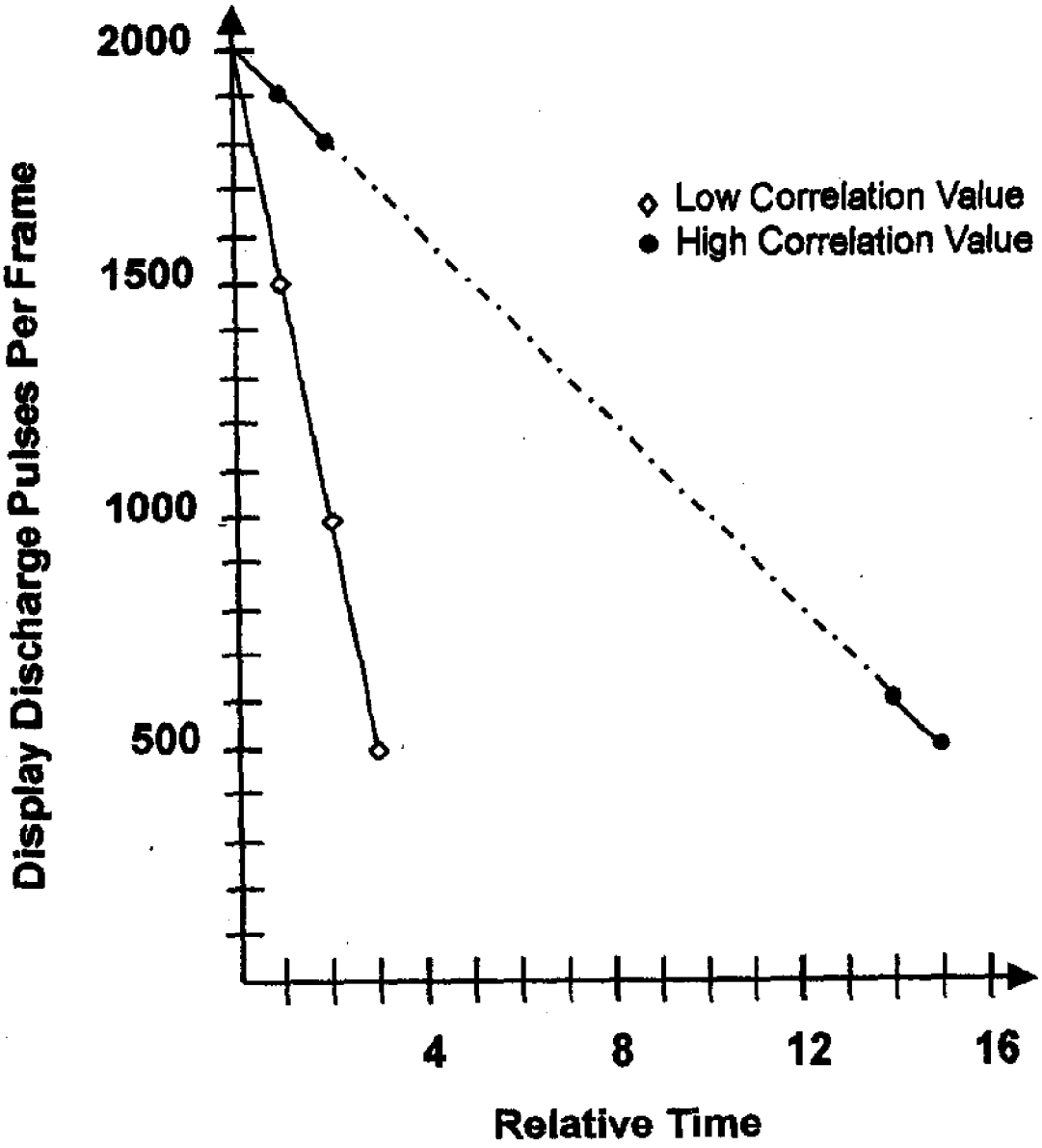
FIG. 8 is a graph showing relative rates of change in a number of discharge pulses in a frame for a high correlation value and for a low correlation value.

For Example, where the display-discharge number changes from 2000 to 500, the display discharge number is varied for changing such as for example, 2000→1900→1800→. . . 600→500, where the control of the display-discharge number is slow. In contrast, the display-discharge number is varied for changing such as, for example, 2000→1500→1000→500, where the control of the display-discharge number is fast. A visual representation of the rate of change of the number of discharge pulses in a frame is shown in FIG. 8. In FIG. 8, the line identified with circles represents a changing of the number of discharge pulses in a frame where the correlation is high and the line identified with the triangles represents a changing of the number of discharge pulses in a frame where the correlation is low. Thus, the slope of each line represents a rate of change of the number of display-discharge pulses in a frame depending on the correlation.

As described in the foregoing, an apparatus and method for controlling the drive power of a plasma display panel according to the present invention keeps power consumption constant without imposing an electric shock on the system.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method for controlling drive power of a plasma panel display, the method comprising:

preestimating a load ratio, the load ratio being a ratio of a number of discharge cells to be display-discharged during a present frame to a total number of discharge cells in the plasma display panel;

determining a number of display-discharge pulses for the present frame, the determined number of display-discharge-pulses being inversely proportional to the preestimated load ratio for the present frame;

measuring a correlation of the present frame of a video signal with a preceding frame of the video signal to obtain a correlation value; and regulating a rate of change of the number of display-discharge pulses between the preceding frame and the present frame depending on the correlation value.

2. The method of claim 1, wherein the step of preestimating the load ratio comprises calculating an average signal level of the video signal.

3. The method of claim 1, wherein the step of measuring the correlation comprises:

dividing discharge cells of the plasma display panel into a plurality of groups, each group corresponding to a predetermined area of a screen;

calculating an average signal level of each group per frame; and comparing the calculated average signal level of each group in the present frame with that of a corresponding group in the preceding frame and obtaining the correlation value, the correlation value being a number corresponding to a number of the groups in the present frame having a same average signal level as the corresponding groups in the preceding frame.

4. The method of claim 1, wherein the step of regulating comprises:

comparing the correlation value with a predetermined reference value; and changing the number of display-discharge pulses in the present frame such that if the correlation value is greater than the predetermined reference value the rate of change of the number of display-discharge pulses is less than the rate of change of the number of display-discharge pulses when the correlation value is less than the predetermined reference value.

5. An apparatus for controlling the drive power of a plasma display panel, the apparatus comprising:

a load ratio preestimator which preestimates a load ratio for a frame of an input video signal, the load ratio being a ratio of a number of discharge cells to be display-discharged to a total number of discharge cells in the plasma display panel;

a discharge number controller which controls a number of display-discharge pulses in the frame to be inversely proportional to the preestimated load ratio for the frame;

a correlation number counter which processes the input video signals and measures a correlation of the frame with a preceding frame thereof; and a control-timing regulator which controls an output timing of the discharge number controller according to the measured correlation and regulates a rate of change of the number of display-discharge pulses in the frame such that a transition resulting from a change in the number of display-discharge pulses in the preceding frame and the number of display-discharge pulses in the frame is regulated according to the measured correlation.

6. The apparatus of claim 5, wherein the load ratio preestimator preestimates the load ratio by calculating an average signal level of the input video signal.

* * * * *

UNITED STATES PATENT AND TRADEMARK OFFICE

CERTIFICATE OF CORRECTION

PATENT NO. : 6,788,276 B2
DATED : September 7, 2004
INVENTOR(S) : Yoon-phil Eo

It is certified that error appears in the above-identified patent and that said Letters Patent is hereby corrected as shown below:

Delete the title page and substitute therefor the attached title page.

Delete Drawing Sheets 1-4 and substitute therefor the attached Drawing Sheets 1-5.

Signed and Sealed this

Nineteenth Day of April, 2005

JON W. DUDAS
*Director of the United States Patent and Trademark Office*

(12) United States Patent
Eo

(10) Patent No.: US 6,788,276 B2
(45) Date of Patent: Sep. 7, 2004

(54) APPARATUS FOR CONTROLLING DRIVE-POWER OF PLASMA DISPLAY PANEL AND A METHOD THEREFOR

(75) Inventor: Yoon-phil Eo, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 64 days.

(21) Appl. No.: 09/778,962

(22) Filed: Feb. 8, 2001

(65) Prior Publication Data

US 2001/0026253 A1 Oct. 4, 2001

(30) Foreign Application Priority Data

Feb. 8, 2000 (KR) ..... 2000-5731

(51) Int. Cl.[7] ..... G09G 3/28
(52) U.S. Cl. ..... 345/60; 345/204
(58) Field of Search ..... 345/60–72, 204, 345/211–213; 315/169.4

(56) References Cited

U.S. PATENT DOCUMENTS 6,310,588 B1 * 10/2001 Kawahara et al. ..... 345/63
6,326,938 B1 * 12/2001 Ishida et al. ..... 345/211

FOREIGN PATENT DOCUMENTS

| | | | | |
|---|---|---|---|---|
| JP | 08-065583 | * | 3/1996 | ..... H04N/5/44 |
| JP | 08-205049 | * | 8/1996 | ..... H04N/5/57 |
| JP | 2000-194318 | * | 7/2000 | ..... G09G/3/28 |

* cited by examiner

*Primary Examiner*—Alexander Eisen
(74) *Attorney, Agent, or Firm*—McGuireWoods LLP

(57) ABSTRACT

An apparatus for controlling the drive power of a plasma display panel in an driving apparatus of the plasma display panel. The apparatus preestimates a load ratio of an input video signal on a frame-by-frame basis, controls a number of display-discharge pulses in a corresponding frame to be inversely proportional to the preestimated load ratio, measures correlation of each frame with a preceding frame, controls the output timing of a discharge number controller according to the correlation and regulates a rate of change of the number of display-discharge pulses in a frame. The number of display discharge pulses in a frame is regulated to change more rapidly where the correlation is low and than where the correlation is high.

6 Claims, 5 Drawing Sheets

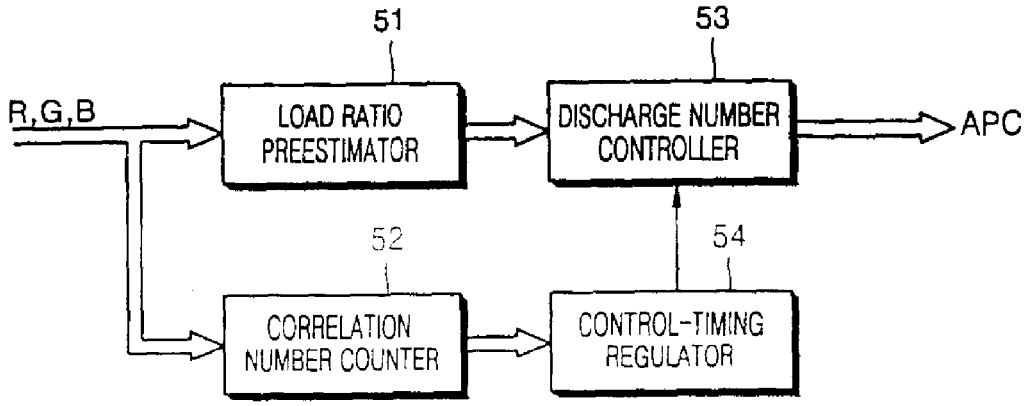

FIG. 6

11

| | | | | | | | | |
|---|---|---|---|---|---|---|---|---|
| G11 | G12 | G13 | G14 | G15 | G16 | G17 | G18 | G19 |
| G21 | G22 | G23 | G24 | G25 | G26 | G27 | G28 | G29 |
| G31 | G32 | G33 | G34 | G35 | G36 | G37 | G38 | G39 |
| G41 | G42 | G43 | G44 | G45 | G46 | G47 | G48 | G49 |
| G51 | G52 | G53 | G54 | G55 | G56 | G57 | G58 | G59 |
| G61 | G62 | G63 | G64 | G65 | G66 | G67 | G68 | G69 |
| G71 | G72 | G73 | G74 | G75 | G76 | G77 | G78 | G79 |
| G81 | G82 | G83 | G84 | G85 | G86 | G87 | G88 | G89 |
| G91 | G92 | G93 | G94 | G95 | G96 | G97 | G98 | G99 |

FIG. 7B

11

PRECEDING FRAME

| | | | | | | | | |
|---|---|---|---|---|---|---|---|---|
| 0 | 0 | 100 | 10 | 20 | 30 | 40 | 0 | 0 |
| 0 | 0 | 10 | 20 | 50 | 60 | 70 | 0 | 0 |
| 0 | 0 | 80 | 90 | 100 | 110 | 120 | 0 | 0 |
| 0 | 0 | 130 | 140 | 150 | 160 | 170 | 0 | 0 |
| 0 | 180 | 190 | 200 | 1400 | 1300 | 1400 | 0 | 0 |
| 1700 | 1500 | 210 | 220 | 1500 | 1500 | 500 | 0 | 0 |
| 2000 | 1700 | 1700 | 230 | 240 | 250 | 260 | 0 | 0 |
| 270 | 280 | 290 | 300 | 400 | 500 | 600 | 0 | 0 |
| 700 | 800 | 900 | 1000 | 1500 | 1300 | 900 | 0 | 0 |

FIG. 7A

11

PRESENT FRAME

| | | | | | | | | |
|---|---|---|---|---|---|---|---|---|
| 0 | 0 | 100 | 900 | 890 | 870 | 400 | 0 | 0 |
| 0 | 0 | 10 | 20 | 750 | 760 | 700 | 0 | 0 |
| 0 | 0 | 300 | 320 | 350 | 330 | 310 | 0 | 0 |
| 0 | 0 | 430 | 470 | 460 | 450 | 400 | 0 | 0 |
| 0 | 180 | 250 | 290 | 1400 | 1300 | 1400 | 0 | 0 |
| 1700 | 1500 | 900 | 1000 | 1500 | 1500 | 500 | 0 | 0 |
| 2000 | 1700 | 1700 | 390 | 480 | 450 | 460 | 0 | 0 |
| 300 | 310 | 320 | 390 | 380 | 510 | 520 | 0 | 0 |
| 10 | 20 | 30 | 40 | 70 | 80 | 60 | 0 | 0 |